US010908541B2

(12) United States Patent
Mochizuki et al.

(10) Patent No.: US 10,908,541 B2
(45) Date of Patent: Feb. 2, 2021

(54) IMAGE HEATING APPARATUS WHICH ATTAINS SECURE FIXING OF AN UNFIXED IMAGE AND REDUCTION OF ENERGY TO BE CONSUMED WHILE SECURING SLIDABILITY OF A FILM

(71) Applicant: CANON KABUSHIKI KAISHA, Tokyo (JP)

(72) Inventors: Keisuke Mochizuki, Suntou-gun (JP); Satoru Taniguchi, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/717,109

(22) Filed: Dec. 17, 2019

(65) Prior Publication Data

US 2020/0209788 A1 Jul. 2, 2020

(30) Foreign Application Priority Data

Dec. 27, 2018 (JP) ..... 2018-245434

(51) Int. Cl.
*G03G 15/20* (2006.01)

(52) U.S. Cl.
CPC ..... *G03G 15/2039* (2013.01); *G03G 15/2025* (2013.01)

(58) Field of Classification Search
CPC ..... G03G 15/2025; G03G 15/2039–205
See application file for complete search history.

(56) References Cited

U.S. PATENT DOCUMENTS

2015/0323890 A1* 11/2015 Nakamoto ..... G03G 15/2025 399/68
2019/0204765 A1* 7/2019 Morimoto ..... G03G 15/2025

FOREIGN PATENT DOCUMENTS

JP H0527619 A 2/1993

* cited by examiner

*Primary Examiner* — Carla J Therrien
(74) *Attorney, Agent, or Firm* — Canon U.S.A., Inc. IP Division

(57) ABSTRACT

An image heating apparatus fixes a toner image by heating a recording material bearing an image when a film rotates around a support member which supports a nip forming member forming a nip portion with a rotating member while sliding on the nip forming member. The image heating apparatus includes a temperature detection element which outputs information about a detected temperature to a control unit which controls a temperature of the heating member supplying heat to the rotating member or the film, a first supply member which supplies a lubricant to the film in contact with the film, and a second supply member which is different from the first supply member and supplies the lubricant to the film in contact with the film, wherein the temperature detection element is arranged between the first supply member and the second supply member in a longitudinal direction of the support member.

20 Claims, 9 Drawing Sheets

IMAGE HEATING APPARATUS WHICH ATTAINS SECURE FIXING OF AN UNFIXED IMAGE AND REDUCTION OF ENERGY TO BE CONSUMED WHILE SECURING SLIDABILITY OF A FILM

BACKGROUND OF THE DISCLOSURE

Field of the Disclosure

The present disclosure relates to an image heating apparatus as a fixing unit which heats and fixes an unfixed toner image formed and borne on a recording material in an image forming apparatus such as a copying machine and a printer adopting an electrophotographic method and an electrostatic recording method.

Description of the Related Art

Conventionally, for example, image heating apparatuses often adopt a heat roller system in which a recording material (heated material) is heated while being nipped and conveyed in a nip portion formed by a heat roller (heating member) maintained at a predetermined temperature and a pressure roller (pressure member) which is pressed in contact with the heat roller.

In addition to the heat roller system, image heating apparatuses adopting a film heating system are discussed (for example, Japanese Patent Application Laid-Open No. 5-27619). An image heating apparatus adopting the film heating system includes a heater as a heat source, a support member for supporting the heater (a heater holder), an endless heat-resistant film (hereinbelow, a film) which faces and is in contact with the heater, and a pressure roller which tightly adheres a recording material to the heater via the film. The image heating apparatus adopting the film heating system applies heat from the heater to a recording material via the film in a nip portion formed by the heater and the pressure roller, and thus an unfixed image formed and borne on a recording material surface is heated and fixed to the recording material surface.

The above-described image heating apparatus adopting the film heating system can use a low heat capacity heater. Thus, the image heating apparatus can save power and shorten a wait time (shorten a first printout time) compared to an apparatus adopting the heat roller system.

On the other hand, the image heating apparatus adopting the film heating system is required to have a configuration which secures slidability of an inner peripheral surface of the film with respect to the heater (a nip forming member) in a fixing nip portion and does not increase rotation torque of the image heating apparatus. Therefore, a configuration is discussed in which a lubricant such as fluorine grease and silicone oil is applied in advance on a surface of a ceramic heater.

In a case of an image heating apparatus in which a supply member is impregnated with a lubricant and the lubricant is supplied to an inner peripheral surface of a film, a lubricant supply amount per unit time varies depending on shape variation such as a density of the supply member. Particularly in recent years, an image heating apparatus has been required to have high durability. In a case where a retaining amount of a lubricant is increased, and a lubricant having a low consistency (high viscosity) is used in order to prolong a life of an image heating apparatus, there is a tendency that variation in a lubricant amount is remarkable.

If the amount of lubricant applied to the inner peripheral surface of the film varies as described above, heat characteristics become uneven in the image heating apparatus, and it becomes difficult to attain both of more secure fixing of an unfixed image to a recording material and reduction of energy to be consumed.

SUMMARY OF THE DISCLOSURE

The present disclosure is directed to an image heating apparatus which can attain both of more secure fixing of an unfixed image to a recording material and reduction of energy to be consumed while securing slidability of a film with respect to a heater in a nip portion throughout a product life.

An image heating apparatus according to the present disclosure which heats a recording material bearing an image and fixes a toner image. The image heating apparatus includes a rotating member, a nip forming member configured to form a nip portion with the rotating member, a support member configured to support the nip forming member, an endless film of which an inner peripheral surface slides on the nip forming member at the nip portion when the endless film rotates around the support member, a heating member configured to supply heat to the rotating member or the film, a temperature detection element configured to output information about a detected temperature to a control unit which controls a temperature of the heating member, a first supply member configured to supply a lubricant to the film in contact with the film, and a second supply member which is different from the first supply member and is configured to supply the lubricant to the film in contact with the film. The temperature detection element is arranged between the first supply member and the second supply member in a longitudinal direction of the support member.

Further features and aspects of the present disclosure will become apparent from the following description of example embodiments with reference to the attached drawings.

DESCRIPTION OF THE EMBODIMENTS

The present disclosure will be described in detail below based on various example embodiments with reference to the attached drawings. However, dimensions, materials, and shapes of components and their relative arrangements described in the example embodiments are to be appropriately changed depending on a configuration and various conditions of an apparatus to which the present disclosure is applied. In other words, the scope of the present disclosure is not limited only to the example embodiments described below.

(1) Example Image Forming Apparatus

Figure 1:
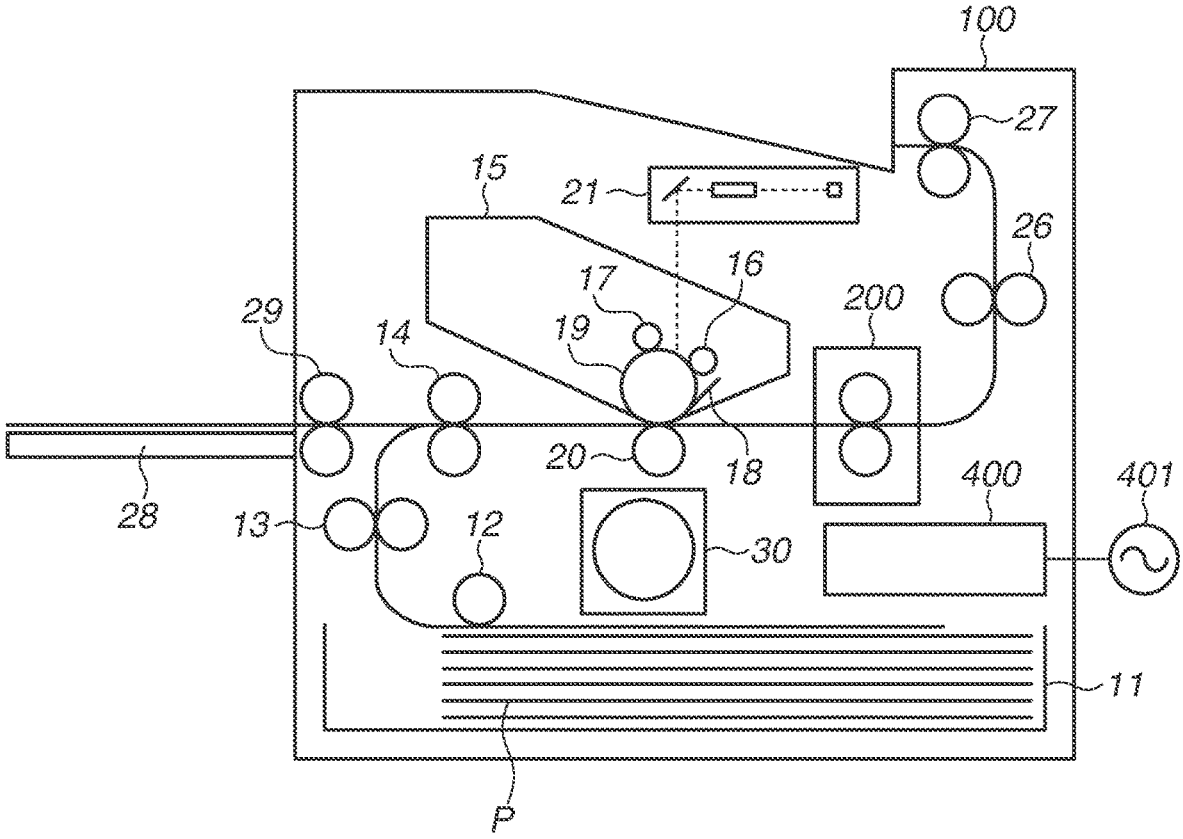
FIG. 1 illustrates a cross-sectional view of an image forming apparatus according to a first example embodiment.

First, a configuration of an image forming apparatus 100 is described with reference to FIG. 1. FIG. 1 is a schematic cross-sectional view of the image forming apparatus 100 according to a first example embodiment of the present disclosure. The image forming apparatus 100 is a laser beam printer which forms an image on a recording material P using an electrophotographic method.

The image forming apparatus 100) executes image forming by following operations when a print instruction is received from an external device (not illustrated) such as a personal computer (PC). In a case where a print signal is generated, a laser scanner 21 emits a laser beam modulated based on image information and scans a surface of a photosensitive drum 19 charged to a predetermined polarity by a charging roller 16. Accordingly, an electrostatic latent image is formed on the photosensitive drum 19. Toner is supplied from a developing roller 17 to the electrostatic latent image, and thus the electrostatic latent image on the photosensitive drum 19 is developed and becomes a toner image. Meanwhile, a recording material (recording paper) P stacked in a sheet feeding cassette 11 is fed by a pickup roller 12 one by one and conveyed to a registration roller 14 by a conveyance roller 13. Further, the recording material P is conveyed from the registration roller 14 to a transfer position formed by the photosensitive drum 19 and a transfer roller 20 in synchronization with timing at which the toner image on the photosensitive drum 19 reaches the transfer position. The toner image on the photosensitive drum 19 is transferred to the recording material P in a process in which the recording material P passes through the transfer position. Subsequently, the recording material P is heated by an image heating apparatus 200, and thus the toner image is heated and fixed to the recording material P. The recording material P bearing the fixed toner image thereon is discharged to a tray on an upper part of the image forming apparatus 100 by conveyance rollers 26 and 27.

The image forming apparatus 100 is provided with a cartridge 15 which includes the photosensitive drum 19 as an image bearing member, the charging roller 16 as a charging unit, the developing roller 17 as a developing unit, and a cleaning blade 18 as a cleaning unit. According to the present example embodiment, the photosensitive drum 19, the charging roller 16, the developing unit including the developing roller 17, and the charging unit including the cleaning blade 18 are configured as the cartridge 15 which is mountable and detachable with respect to an apparatus main body of the image forming apparatus 100.

The photosensitive drum 19 is driven to rotate at a predetermined circumferential velocity (a process speed) in a counterclockwise direction. The charging roller 16 performs processing (primary charging) to uniformly charge a peripheral surface of the photosensitive drum 19 to a predetermined polarity and potential. A charge processed surface of the primarily charged photosensitive drum 19 is scanned and exposed (irradiated) with a laser beam emitted from the laser scanner 21. The laser scanner 21 as an image exposure unit outputs an ON/OFF modulated laser beam in response to a time-series electrical digital pixel signal of target image information input from an external device, such as an image scanner and a computer, which is not illustrated. Accordingly, a charge on an exposed bright portion of the peripheral surface of the photosensitive drum 19 is removed by the scanning exposure, and an electrostatic latent image corresponding to the target image information is formed on the photosensitive drum 19.

The developing roller 17 bears developer (toner) on its surface, supplies the toner to the peripheral surface of the photosensitive drum 19, and sequentially develops the electrostatic latent image formed on the peripheral surface of the photosensitive drum 19 as a toner image. In a case of a laser printer, a reversal development method is generally used in which an electrostatic latent image is developed by causing toner to adhere to an exposed bright portion thereof.

The recording material P is stacked and stored in the sheet feeding cassette 11 which is mountable and detachable with respect to the image forming apparatus 100. The image forming apparatus 100 includes the pickup roller 12 which separates and feeds the recording material P one by one, the conveyance roller 13 which conveys the recording material P, and the registration roller 14 which adjusts feeding timing of the recording material P. The recording material P in the sheet feeding cassette 11 is separated and fed one by one by the pickup roller 12 when the pickup roller 12 is driven based on a sheet feeding start signal, and then the recording material P is introduced into a transfer portion formed by the photosensitive drum 19 and the transfer roller 20 (a transfer member) by the registration roller 14 via the conveyance roller 13 at predetermined timing. In other words, the registration roller 14 controls conveyance of the recording material P so that a leading edge portion of the recording material P reaches the transfer portion in synchronization with timing when a leading edge portion of the toner image on the photosensitive drum 19 reaches the transfer portion. The image forming apparatus 100 may have a configuration in which the recording material P stacked on a manual feed tray 28 is separated and fed by a sheet feeding roller 29 one by one and introduced into the transfer portion formed by the photosensitive drum 19 and the transfer roller 20 by the registration roller 14 at predetermined timing.

The recording material P introduced to the transfer portion is nipped and conveyed at the transfer portion, and during the same period, the transfer roller 20 is applied with a transfer voltage (transfer bias) controlled to a predetermined value from a transfer bias application power source (not illustrated). For the transfer roller 20, an elastic sponge roller is generally used in which a semiconductive sponge elastic layer of which resistance is adjusted to about $1*10^6$ to $1*10^{10}\Omega$ by carbon, an ion conductive filler, and the like is formed on a core metal made of iron (Fe) and the like. According to the present example embodiment, an ion conductive transfer roller is used which includes an elastic layer having conductivity and formed in a roller shape concentrically and integrally on an outer periphery of a core metal by reacting nitril-butadiene rubber (NBR) and a surface active agent and the like. The transfer roller having a resistance value in a range from $1*10^8$ to $5*10^8\Omega$ is used.

The transfer roller 20 is applied with a transfer bias having a polarity opposite to that of the toner, so that the toner image formed on the peripheral surface of the photosensitive drum 19 is electrostatically transferred to a surface of the recording material P at the transfer portion. The recording material P on which the toner image is transferred is conveyed from the transfer portion and introduced to the image heating apparatus 200 in which fixing processing for heating and pressing the toner image is performed. The recording material P on which the toner image is fixed in the image heating apparatus 200 is discharged onto a sheet discharge tray of the image forming apparatus 100 via the conveyance roller 26 for conveying the recording material P and a sheet discharge roller 27 for discharging the recording material P, so that image forming is completed.

After the toner image is transferred to the recording material P, transfer residual toner, paper dust and the like are removed from the peripheral surface of the photosensitive drum 19 by the cleaning blade 18, and the peripheral surface of the photosensitive drum 19 is subjected to primary charging again and used for next image forming.

(2) Example Image Heating Apparatus

Figure 2:
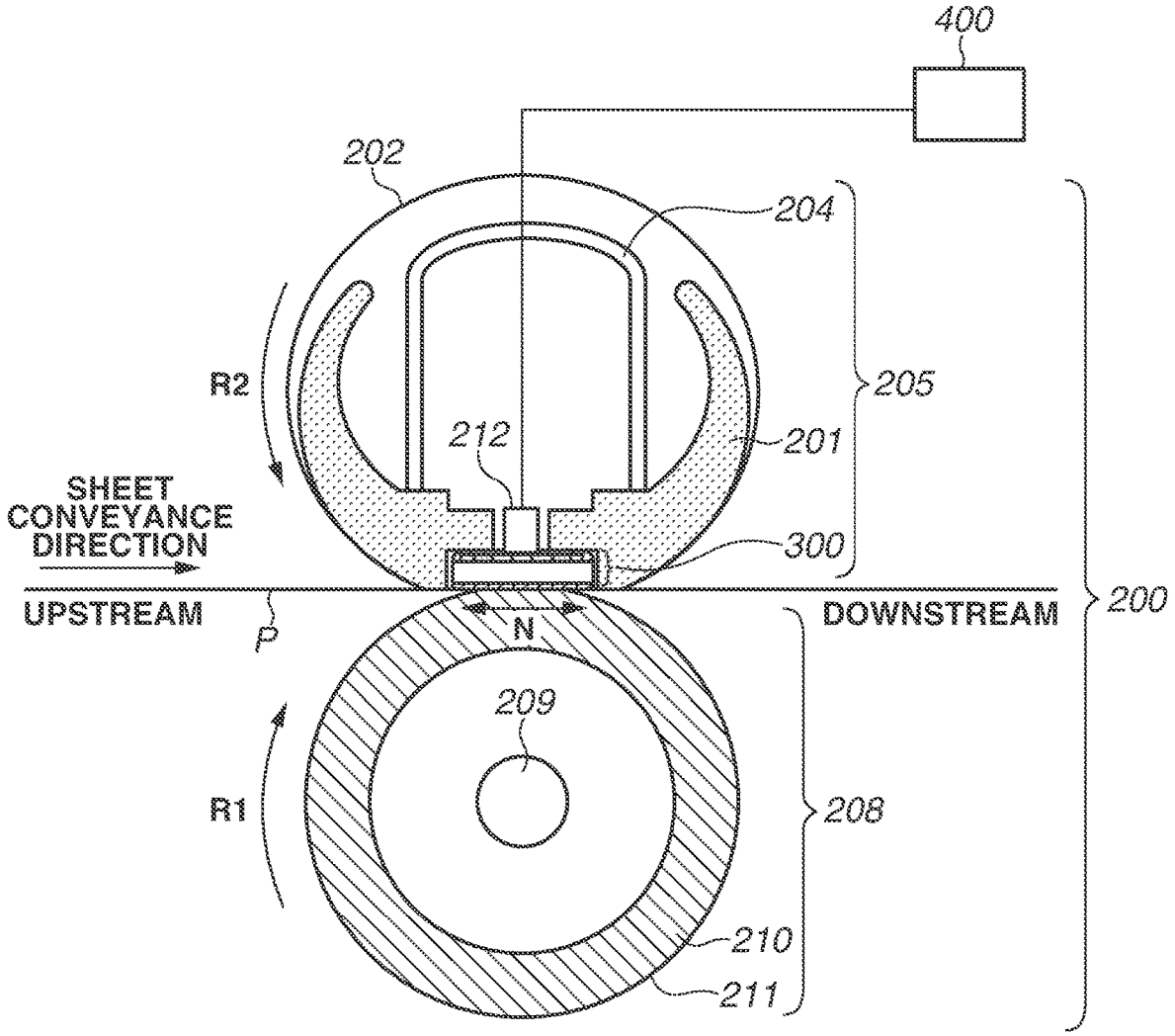
FIG. 2 illustrates a cross-sectional view of an image heating apparatus according to the first example embodiment.

Next, the image heating apparatus 200 adopting the film heating system according to the present example embodiment is described. FIG. 2 is a schematic cross-sectional view in a transverse direction of the image heating apparatus 200 according to the present example embodiment. The image heating apparatus 200 includes a film unit (a belt unit) 205 and a pressure roller (a rotating member) 208 as a pressure member.

A driving force of a motor 30 in FIG. 1 which is controlled by a control unit (an engine controller) 400 (FIG. 9) is transmitted to a driving gear, and thus the pressure roller 208 can be driven as a driving rotating member in a direction of an arrow R1 in FIG. 2. The pressure roller 208 includes a core metal 209, an elastic member layer 210, and a surface layer 211 on an outermost layer. According to the present example embodiment, an aluminum core metal is used as the core metal 209, silicone rubber is used as the elastic member layer 210, and a perfluoroalkoxy alkane (PFA) tube having a thickness of approximately 50 μm is used as the surface layer 211. An outer diameter of the pressure roller 208 is 25 mm, and a thickness of the elastic member layer 210 is approximately 3 mm.

The film unit 205 includes a heater (a heating member) 300, a support member 201, a film 202, and a stay (a reinforcing member) 204. Inside of the film 202, the heater 300, the support member (guide member) 201 which holds the heater 300 and guides rotation of the film 202, and the stay 204 which holds and reinforces the support member 201 are arranged as an internal assembly.

Figure 9:
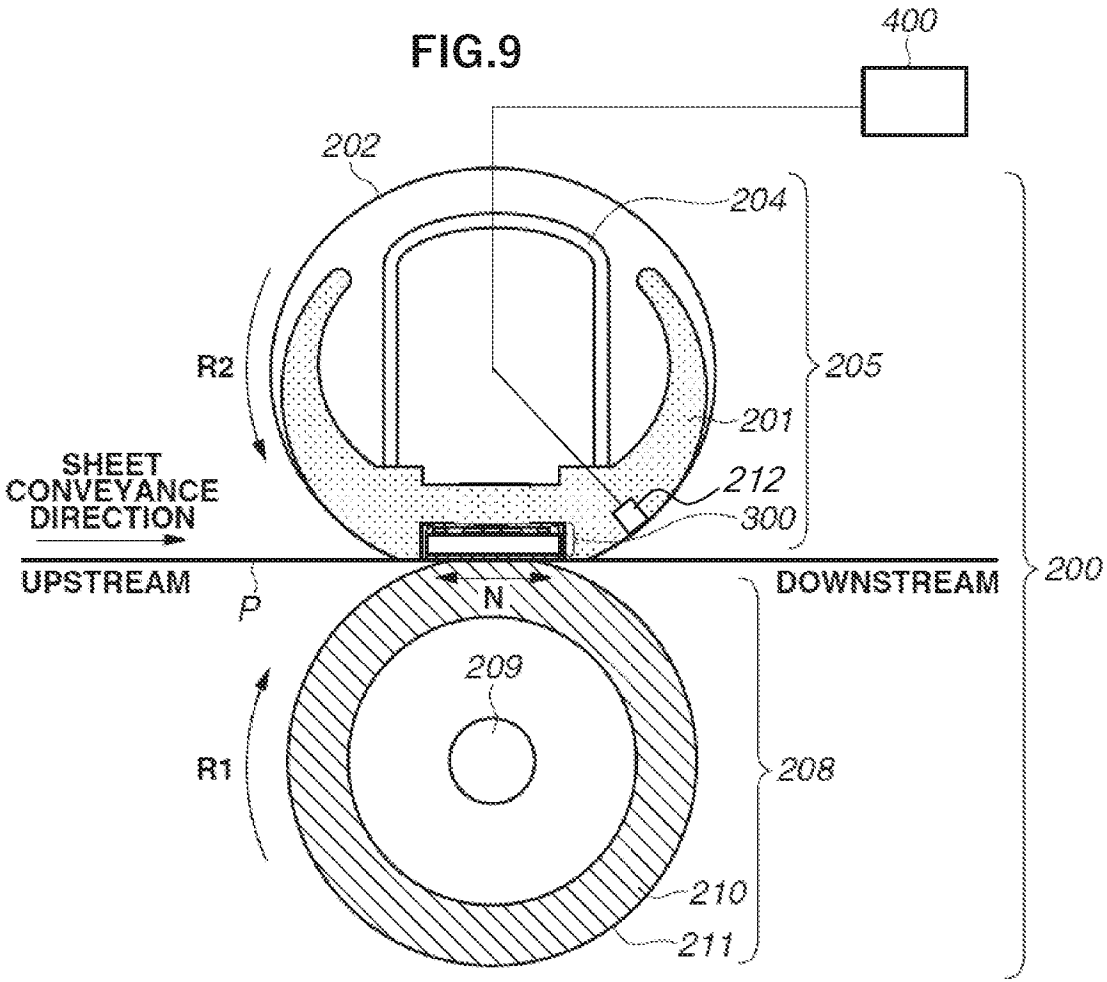
FIG. 9 illustrates a cross-sectional view of the image heating apparatus according to one embodiment.

As the heater 300, specifically, a ceramic heater having an elongate shape is used, and a surface opposite to a front surface of a substrate on which a resistance heating element and an insulation protective layer are formed is arranged upward to face the film 202. More specifically, the heater 300 has a low heat capacity plate shape and includes an electric heating resistor layer which is made of a material such as silver palladium (Ag/Pd), ruthenium oxide (RuO2), and tantalum nitride (Ta2N) and formed by screen printing and the like on an insulating ceramic substrate made of a material such as aluminum oxide and aluminum nitride. Further, a glass layer is formed as an insulation protective layer on the electric heating resistor layer. The heater 300 can detect a temperature using a thermometry element (a thermistor) 212 (FIG. 9). According to the present example embodiment, an externally abutting type thermistor separated from the heater 300 is used as the thermometry element 212.

The support member 201 has heat resistance and rigidity and further has a support function of supporting the heater 300 on a bottom surface thereof along a longitudinal direction and a film guide function of guiding rotation of the film 202. The support member 201 can be formed by a high heat resistant resin, such as polyimide, polyamide-imide, poly ether ether ketone (PEEK), poly phenylene sulfide (PPS), and a liquid crystal polymer, and a composite material of these resins and ceramics, metals, glass, and the like. According to the present example embodiment, a liquid crystal polymer is used. The support member 201 is further supported by the stay 204 having rigidity. According to the present example embodiment, the stay 204 formed of a metal is used.

The film 202 is externally fitted in a loose manner to the support member 201 which holds the heater 300 and functions as a film guide member and can rotate around the support member 201 while being in contact with the heater 300 at an inner peripheral surface thereof. It is desirable that the film 202 has a film thickness of 20 μm or more and 450 μm or less in order to reduce a heat capacity and shorten a wait time (a first printout time). As the film 202, a single layer film made from poly tetrafluoro ethylene (PTFE). PFA, fluorinated ethylene propylene copolymer (FEP), and the like which have heat resistance or a multi-layer film such as a film made from polyimide, polyamide-imide, PEEK, poly ether sulfone (PES), and PPS coated with PTFE, PFA, FEP, and the like can be used. According to the present example embodiment, a polyimide film having a film thickness of approximately 60 μm coated with PFA on an outer peripheral surface thereof is used. A PFA coat layer has a thickness on approximately 15 μm. An outer diameter of the film 202 is 24 mm. Aside from the above-described resin materials, a metal material such as stainless steel (SUS) can be also used for a base layer of the film 202. Heat resistant rubber such as silicone rubber may be formed as an elastic layer between the base layer and a coat layer to improve an image quality.

Each of the heater 300, the support member 201, and the stay 204 has a length longer than a width (a length) of the film 202, and both end sides (a left end side and a right end side) protrude outwards from the edge portions of the film 202. The support member 201 including the heater 300 and the pressure roller 208 are pressed in contact with each other via the film 202 at predetermined pressure against elasticity of an elastic member layer 210 of the pressure roller 208. In the image heating apparatus 200 according to the present example embodiment, the heater 300 functions as a nip portion forming member, and the support member 201 functions as a sliding member (a backup member) which abuts on the inner peripheral surface of the film 202. Thus, a nip portion N having a predetermined width is formed between the film 202 and the pressure roller 208 in a sheet conveyance direction. According to the present example embodiment, the nip portion N is configured to have a width (a length in the conveyance direction of the recording material P) of approximately 9.0 mm and a length (a length in a direction perpendicular to the conveyance direction of the recording material P) of 216 mm.

In the image heating apparatus 200, the pressure roller 208 is driven to rotate in the direction of the arrow R1 (clockwise direction) by the motor 30 controlled by the control unit 400 when a print signal is input from an external input device such as a PC. A rotational force is transmitted from the pressure roller 208 to the film 202 by a frictional force between the pressure roller 208 and an outer peripheral surface of the film 202 at the nip portion N, and the film 202 is driven to rotate while the inner peripheral surface of the film 202 is slid by the heater 300 at the nip portion N. Accordingly, the film 202 is moved and rotated in a direction of an arrow R2 (counterclockwise direction) around the support member 201 at a speed approximately the same as a moving speed of the peripheral surface of the pressure roller 208.

According to the image heating apparatus 200, power is supplied from the control unit 400 connected to an alternating-current power source (an outlet) 401 to a power supplying electrode of the heater 300, and thus the heater 300 (the resistance heating element) generates heat. The control unit 400 controls a temperature of the heater 300 by controlling energization to the heater 300 using a triac (not illustrated), which is provided in the control unit 400, based on information about the temperature of the heater 300 output from the thermistor 212. In other words, in a case where the temperature information from the thermistor 212 indicates a lower temperature than a control target temperature (a setting temperature), energization to the heater 300 is increased, and in a case where the temperature information from the thermistor 212 indicates a higher temperature than the control target temperature, energization to the heater 300 is reduced. The temperature of the heater 300 is thus controlled so as to be closer to the setting temperature based on the output of the thermistor 212.

After the heater 300 is controlled to the setting temperature and the film 202 is brought into a state being driven and rotated by the pressure roller 208, the recording material P on which the toner image is transferred is conveyed from the transfer portion to the nip portion N formed by the heater 300 and the pressure roller 208 via the film 202. The recording material P is nipped and conveyed at the nip portion N together with the film 202, so that heat from the heater 300 is applied to the recording material P via the film 202, and an unfixed toner image on the recording material P is heated, pressed, and fixed to the recording material P. The recording material P passing through the nip portion N is separated from the film 202 and further conveyed.

(3) Example Storage Portion and Supply Member

A storage portion 501 and a supply member 500 will be described below with reference to FIGS. 2 to 4.

Figure 3:
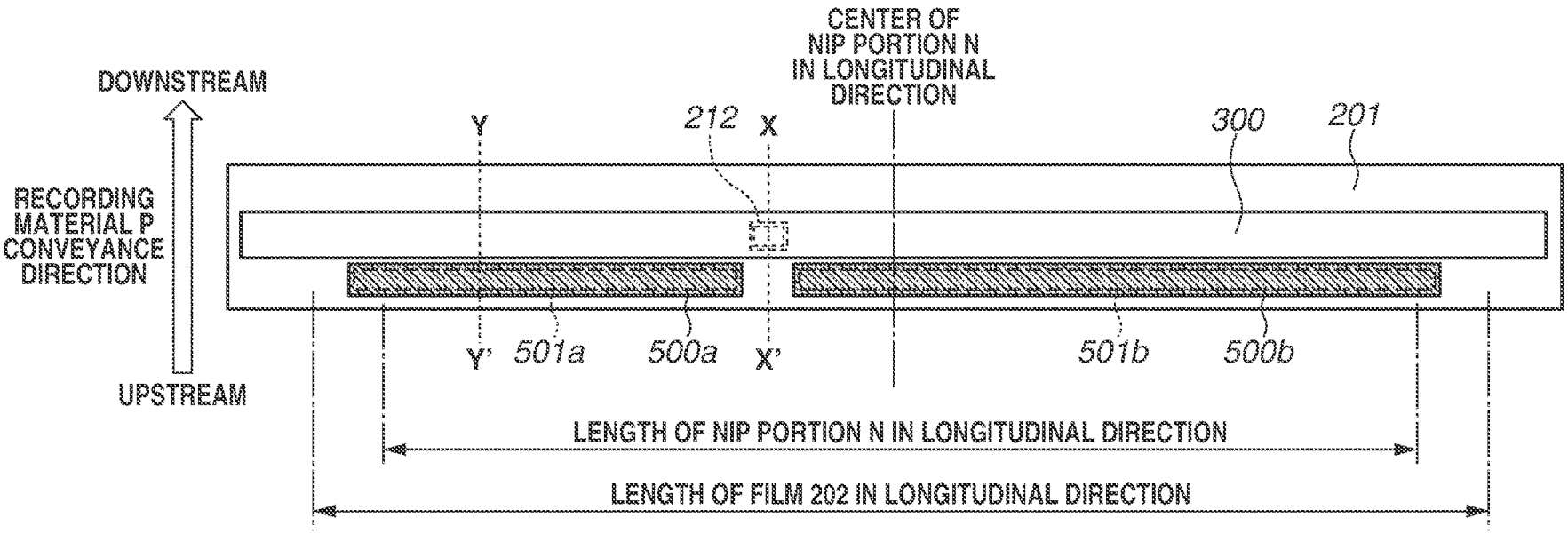
FIG. 3 is a diagram illustrating arrangements in a longitudinal direction of a supply member according to the first example embodiment.
Figure 4:
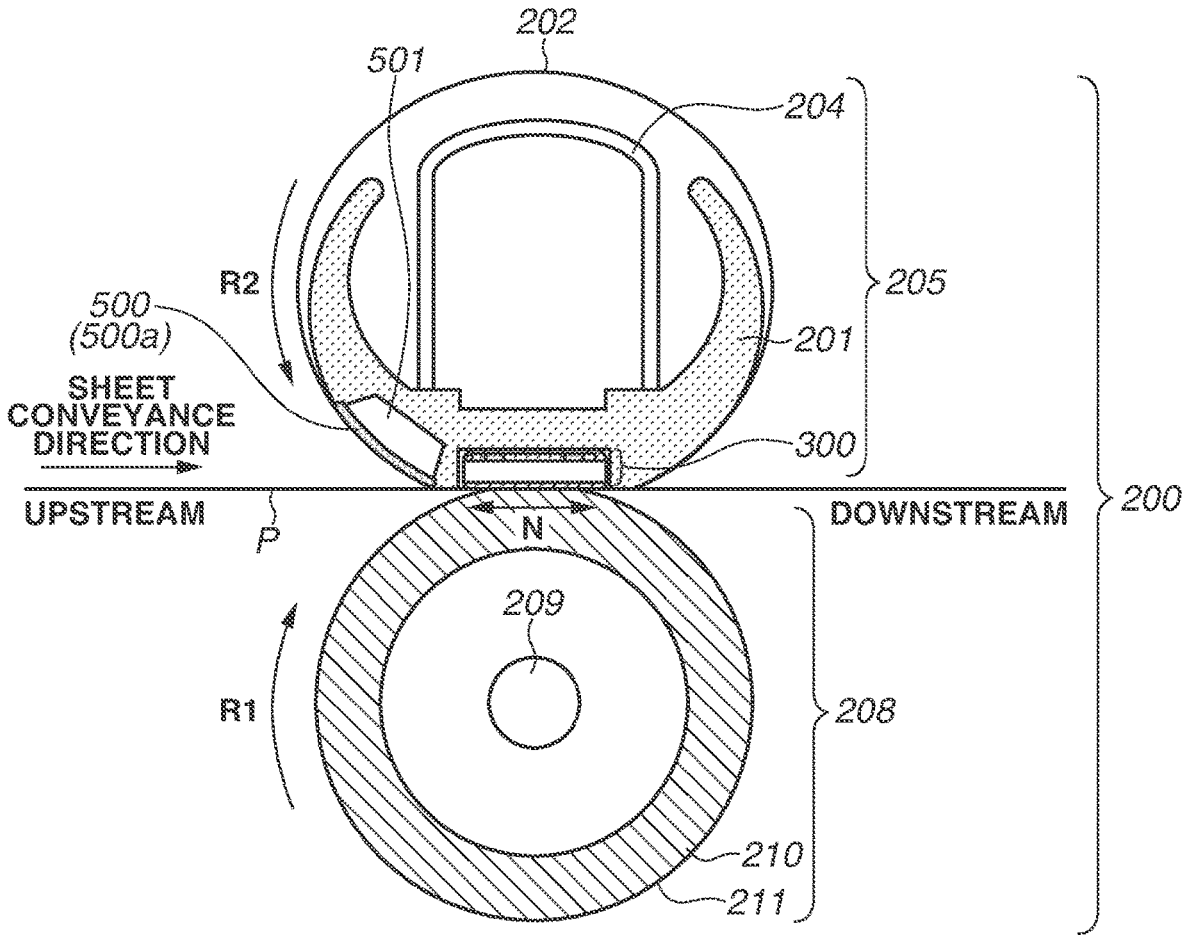
FIG. 4 illustrates a cross-sectional view of the image heating apparatus according to the first example embodiment.

FIGS. 2 and 4 are the cross-sectional views of the image heating apparatus 200 according to the present example embodiment. FIG. 3 is a diagram illustrating arrangements of the storage portion 501 and the supply member 500. FIGS. 2 and 4 are respectively the cross-sectional views of an X-X' cross section and a Y-Y' cross section in FIG. 3.

According to the present example embodiment, the storage portions 501 (501*a* and 501*b*) is formed in the support member 201 on an upstream side of the heater 300 in a rotation direction of the film 202, and a lubricant is stored in the storage portions 501 as illustrated in FIGS. 3 and 4. The supply members 500 (500*a* and 500*b*) having a sheet shape are adhered and arranged respectively to cover opening portions of the storage portions 501 and are in contact with the film 202 to supply the lubricant. As illustrated in FIG. 3, the storage portions 501 according to the present example embodiment are formed on the support member 201 at two positions, and the supply members 500 are provided on the respective storage portions 501. More specifically, the supply members 500*a* and 500*b* are configured to overlap with each other when viewed along a rotation axial direction of the film 202.

In following descriptions, it is described as "the storage portion 501" in the description common to the storage portions 501*a* and 501*b* and is described as "the storage portions 501*a* and 501*b*" in a case where the two storage portions are separately described. The same is applied to the supply members. It is described as "the supply member 500" in the description common to the supply members 500*a* and 500*b* and is described as "the supply members 500*a* and 500*b*" in a case where the two supply members are separately described.

It is desirable that the supply member 500 is a fiber layer of such as a porous fluorine resin, a porous polyimide resin, and felt formed into a sheet shape. Examples of a material of the fiber layer may include an aramid fiber, a glass fiber, and a carbon fiber. Further, it is desirable that the supply member 500 has density of about 30 to 700 g/m$^2$ at a thickness of 1 mm. According to the present example embodiment, a sheet shaped aramid fiber felt having density of 200 g/m$^2$ at a thickness of 1 mm is used as the supply member 500.

Any lubricant may be used as long as the lubricant has heat resistance, such as grease obtained by thickening perfluoropolyether base oil with a fluorine resin and a silicone oil including dimethyl silicone. According to the present example embodiment, grease having the incorporation consistency of 280 measured using a one-half scale by a method prescribed in JIS K 2220 is used.

The lubricant stored in the storage portion 501 flows toward the opening portion by its own weight and is impregnated and permeated into the supply member 500 from the opening portion. The supply member 500 is in contact with the film 202. In a case where the film 202 rotates, the lubricant impregnated into the supply member 500 is applied to the inner peripheral surface of the film 202, and slidability is secured between the film 202 and the heater 300 at the nip portion N.

In the case of a configuration in which a lubricant is only impregnated into a felt pad, an amount of the lubricant impregnated into the felt pad is decreased as the image heating apparatus is used. As a result, the amount of the lubricant to be applied to the inner peripheral surface of the film is also decreased, and the amount of the lubricant on the inner peripheral surface of the film becomes insufficient at the end of the life of the image heating apparatus in some cases. In this regard, the present example embodiment has the configuration which includes the storage portion 501 and the supply member 500, so that the lubricant can be applied to the inner peripheral surface of the film 202 via the supply member 500 disposed on the opening portion of the storage portion 501 at a constant amount throughout the life of the image heating apparatus 200. The lubricant is more easily impregnated into the supply member 500 as its viscosity is lower (a consistency of the lubricant is higher), and a supply amount of the grease per unit time is increased (a supply speed is increased). In addition, the supply amount of the lubricant per unit time is increased as the opening portion of the storage portion 501 is larger and even further increased as a contact area between the supply member 500 and the film 202 is larger. Therefore, a parameter of the lubricant such as viscosity is appropriately adjusted, so that the lubricant is stably supplied to the inner peripheral surface of the film 202 to secure stable slidability between the film 202 and the heater 300 at the nip portion N.

According to the present example embodiment, a predetermined interval is provided between the supply members 500*a* and 500*b*, the storage portion 501*a* and the supply member 500*a* are disposed on one end, and the storage portion 501*b* and the supply member 500*b* are disposed on the other end in the longitudinal direction as illustrated in FIG. 3. If the interval between the supply members 500*a* and 500*b*, i.e., a portion where no supply member 500 is arranged, is too large, it becomes difficult to sufficiently secure the slidability of the film 202 with respect to the heater 300 at the nip portion N. As a result of study by the inventors, it has been found that, in a case where the ratio of a length of the portion where no supply member 500 is arranged is about 15% or more with respect to the length of the nip portion N in the longitudinal direction, the slidability of the film 202 with respect to the heater 300 becomes insufficient, and the rotation torque is increased. Therefore, the interval between the supply members 500*a* and 500*b* is set to 14 mm in the present example embodiment. Further, the supply member 500*a* having a length of 80 mm in the longitudinal direction and the supply member 500*b* having a length of 136 mm in the longitudinal direction are used in the present example embodiment.

The support member 201 is provided with a through hole as illustrated in FIG. 2 and is arranged so that the thermistor 212 can detect the temperature of the heater 300 via the through hole. According to the present example embodiment, the thermistor 212 is disposed between the supply members 500*a* and 500*b* in the longitudinal direction. Specifically, only any of the thermistor 212 and the supply members 500*a* and 500*b* is disposed in a cross section in the transverse direction of the image heating apparatus 200 as illustrated in FIGS. 2 and 4. In other words, the supply member 500 is not installed in a portion where the thermistor 212 is installed in the longitudinal direction. More specifically, an area of the film 202 which is in contact with the supply members 500*a* and 500*b* is configured not to be brought into contact with an area of the heater 300 (an area corresponding to the thermistor 212) which faces an area of the heater 300 which is in contact with the thermistor 212 even in a case where the film 202 rotates. Accordingly, the lubricant is not directly supplied from the supply member 500 to the area of the film 202 which is brought into contact with the area of the heater 300 corresponding to the thermistor 212.

The amount (the supply speed) of the lubricant on the inner peripheral surface of the film 202 depends on a consistency of the lubricant and density of the supply member 500, and the consistency of the lubricant and the density of the supply member 500 vary to no small extent in manufacturing, so that a certain amount of variation occurs in the amount of the lubricant.

On the one hand, temperatures of the film 202 and the heater 300 change depending on the amount of the lubricant on the inner peripheral surface of the film 202. Since the lubricant acts as resistance to heat conduction, heat is hardly transmitted between the heater 300 and the film 202 if the large amount of the lubricant is present on the inner peripheral surface of the film 202. Accordingly, the temperature of the film 202 becomes low. On the other hand, the heater 300 is brought into contact with the lubricant which has a relatively low heat conductivity, and the heat generated from the resistance heating element of the heater 300 is accumulated, so that the temperature of the heater 300 increases.

The heater 300 is controlled to have a temperature close to the setting temperature based on an output of the thermistor 212. The setting temperature of the heater 300 is set to a temperature which is not unnecessarily high in terms of reducing energy consumption of the image heating apparatus 200 as much as possible and can set the film 202 to a temperature at which fixing performance is satisfied in any environment.

As described above, the temperature of the heater 300 becomes higher as the amount of the lubricant on the inner peripheral surface of the film 202 is increased. On the other hand, the temperature of the film 202 becomes lower as the amount of the lubricant on the inner peripheral surface of the film 202 is increased. Therefore, it is necessary to determine the setting temperature of the heater 300 taking into account the variation in the supply amount of the lubricant in the longitudinal direction in order to satisfy the fixing performance in a sheet passing area of the image heating apparatus 200.

In a conventional image heating apparatus, the setting temperature of the heater 300 is set higher so that fixing can be surely performed at the set temperature in consideration of possibility that an upper limit amount and a lower limit amount of the estimated supply amount of the lubricant are supplied to an area of the film 202 corresponding to the thermistor 212 and other areas of the film 202. Accordingly, it is necessary to control the setting temperature of the heater 300 to a higher temperature to satisfy the fixing performance even with respect to any supply amount in a range of the estimated supply amount of the lubricant, and thus the energy consumption of the image heating apparatus 200 cannot be reduced.

In the present disclosure, therefore, the lubricant is not supplied from the supply member 500 to the area of the film 202 corresponding to the thermistor 212. Accordingly, an output of the thermistor 212 which serves as a reference for the temperature control on the heater 300 is not affected by variation in the amount of the lubricant. In other words, in the area of the film 202 corresponding to the thermistor 212, the temperature of the heater 300 which is not affected by the lubricant can be detected compared to the other areas of the thermistor 212. In addition, the lubricant is not supplied to the area of the film 202 corresponding to the thermistor 212, so that the temperature of the film 202 is not lowered. As a result, the influence of variation in the amount of the lubricant included in the output of the thermistor 212 can be eliminated in controlling the setting temperature of the heater 300 such that the temperature of the film 202 at the nip portion N where the fixing processing is performed is set to the temperature at which fixing can be realized. In other words, it is not necessary to set the setting temperature of the heater 300 higher on the assumption that the amounts of the lubricant in the other areas are small compared to the area corresponding to the thermistor 212. Therefore, the energy consumption of the image heating apparatus 200 can be reduced compared to the conventional technique.

Figure 5:
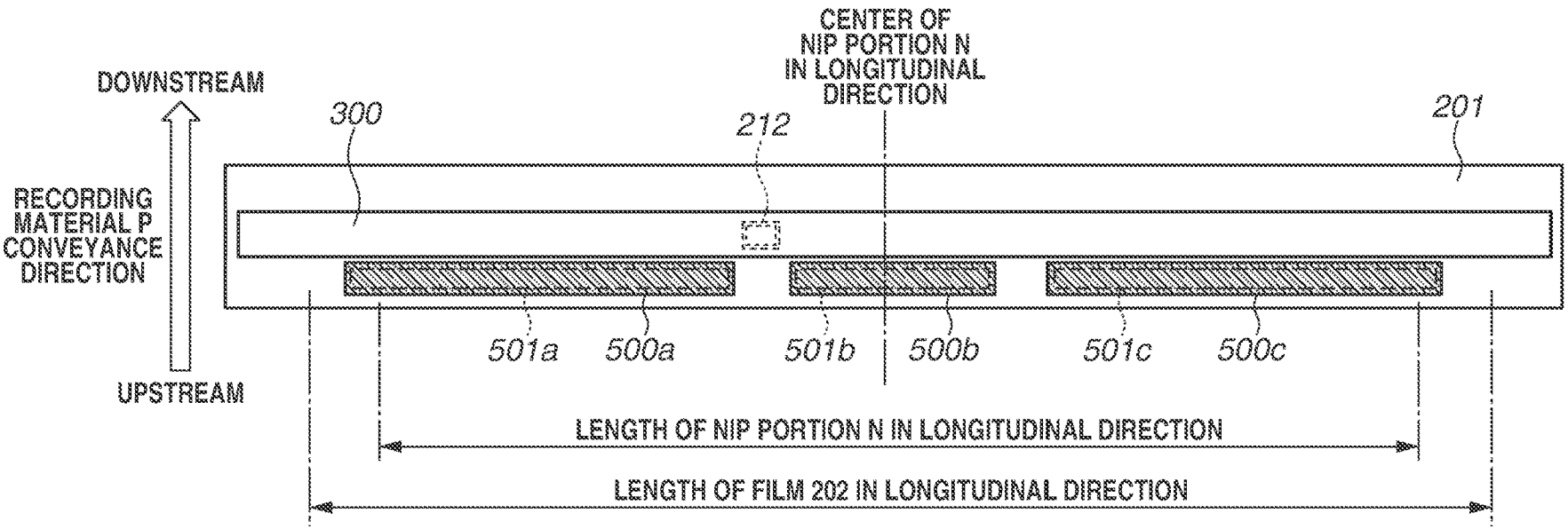
FIG. 5 illustrates an arrangement of a supply member in the longitudinal direction thereof according to a modification of the first example embodiment.

According to the first example embodiment, the configuration includes two supply members 500*a* and 500*b*. However, The configuration may include a plurality of supply members 500 without being limited to two supply members, and the thermistor 212 may be disposed between the plurality of supply members 500 in the longitudinal direction. For example, three supply members 500*a*, 500*b*, and 500*c* may be arranged in the longitudinal direction of the heater 300 as illustrated in FIG. 5. In this case, the storage portions 501*a*, 501*b*, and 501*c* are included respectively corresponding to the supply members 500*a*, 500*b*, and 500*c*. Lengths of the supply members 500*a*, 500*b*, and 500*c* in the longitudinal direction may be respectively 80 mm, 42 mm, and 80 mm. Further, the supply members 500*a*, 500*b*, and 500*c* may be arranged so that an interval between the supply members 500*a* and 500*b* and an interval between the supply members 500*b* and 500*c* are both 14 mm. As with the first example embodiment, an interval between a plurality of supply members 500 next to each other (an interval between the supply members 500*a* and 500*b*) coincides with a position of the thermistor 212 in the longitudinal direction, and the lubricant is not directly supplied from the supply member 500 to an installation portion corresponding to the thermistor 212. Accordingly, as with the first example embodiment, the influence of variation in the supply amount of the lubricant is not included in an output of the thermistor 212, and the energy consumption of the image heating apparatus 200 can be reduced as much as possible.

In a case where a plurality of supply members 500 is provided, it is desirable to arrange the plurality of supply members 500 symmetrically relative to the center of the nip portion N in the longitudinal direction so as to equalize the slidability of the film 202 with respect to the heater 300 at the nip portion N on the right and left sides. If the slidability is not equal on one end side and the other end side in the longitudinal direction, the film 202 may be damaged in some cases. For example, tilting occurs in the rotation axial direction when the film 202 is rotated, which may cause wear of the film 202 on the edge portion and deformation of the film 202 into a trumpet shape, thereby causing crack.

According to the present example embodiment, as positions at which the storage portions 501 and the supply members 500 are set, an example is described in which the storage portions 501 and the supply members 500 are set to positions on an upstream side in the conveyance direction with respect to the nip portion N of the support member 201. However, the storage portions 501 and the supply members 500 may be set to other positions inside of the film 202. For example, the storage portions 501 and the supply members 500 may be set to positions on a downstream side in the conveyance direction with respect to the nip portion N of the support member 201 or on the stay 204.

Figure 6:
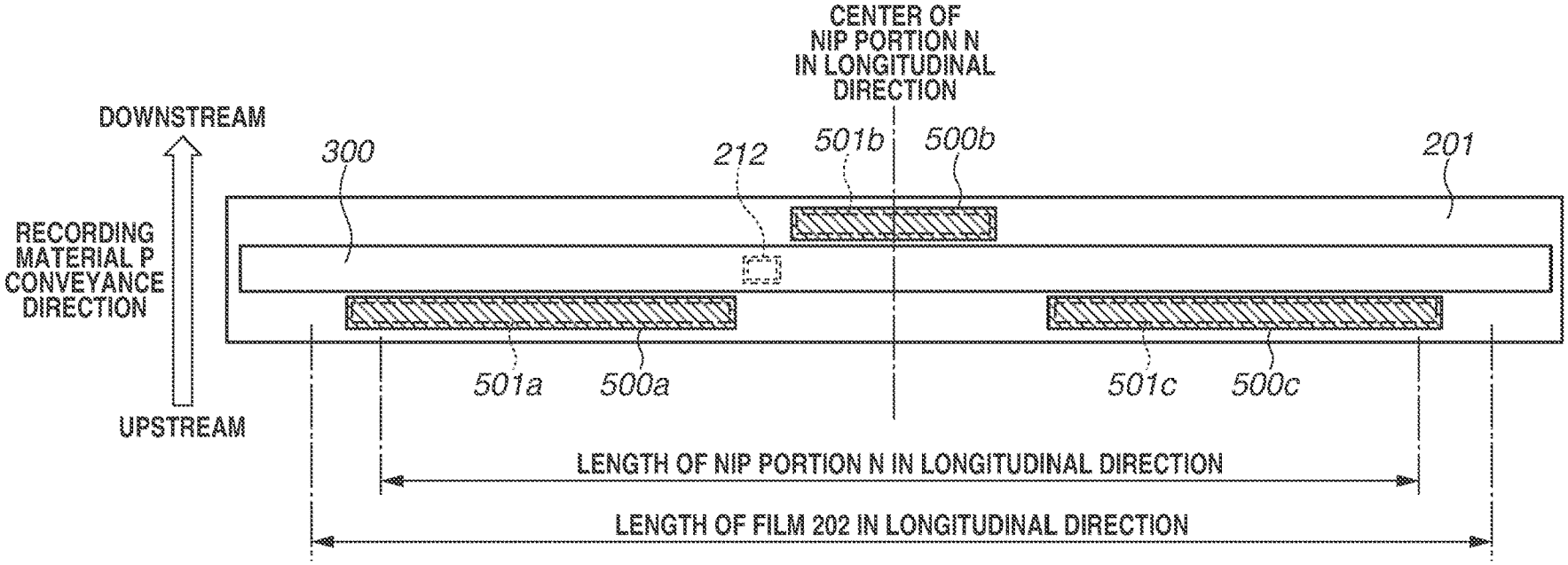
FIG. 6 illustrates an arrangement of a supply member in the longitudinal direction thereof according to a modification of the first example embodiment.

The setting positions of the storage portions 501 and the supply members 500 may be changed in the rotation direction of the film 202. For example, in the configuration which includes three supply members 500*a*, 500*b*, and 500*c* and three storage portions 501*a*, 501*b*, and 501*c* as illustrated in FIG. 6, only the storage portion 501*b* and the supply member 500*b* may be arranged on the downstream side in the conveyance direction with respect to the nip portion N.

Further, in the present example embodiment, the configuration is described in which the heater 300 as the heating element also serves as the nip forming member. However, the heating element and the nip forming member may be formed by different members. For example, a halogen heater may be installed inside of a rotational trajectory of the film 202 as the heating element as a member different from the nip forming member, and the film 202 may be heated by radiation heat from the halogen heater. Further, for example, the base layer of the film 202 may be formed of metal such as stainless-steel, and a coil which inductively heats the film 202 may be installed inside of the rotational trajectory of the film 202.

According to the present example embodiment, the configuration is described in which the thermometry element 212 as the temperature detection element is externally arranged on a back surface of the heater 300. However, another method may be adopted. For example, the thermometry element 212 may be arranged in contact with the inner peripheral surface or an outer surface of the film 202. Further, a thermistor may be arranged on a substrate of the heater 300 and integrally formed with the heater 300. In addition, a temperature of the inner peripheral surface or the outer surface of the film 202 may be detected using a member such as a thermopile which can detect a temperature without contact. Even in a case where any temperature detection element is used, the influence of variation in the supply amount of the lubricant is not included in an output of the thermometry element 212, and the energy consumption of the image heating apparatus 200 can be reduced as much as possible by adopting the configuration according to the present disclosure.

Figure 7:
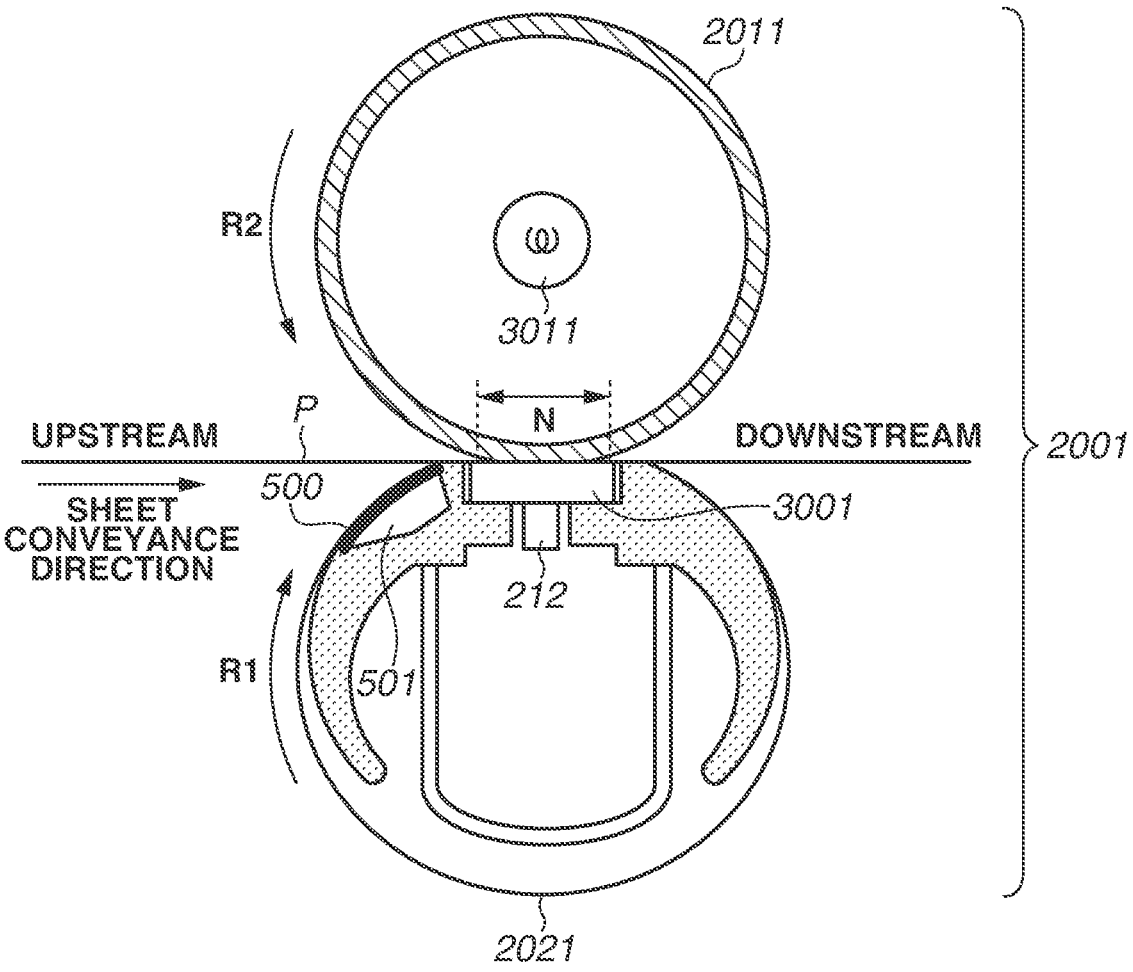
FIG. 7 illustrates a cross-sectional view of an image heating apparatus according to a modification of the first example embodiment.

As illustrated in FIG. 7, the present disclosure may be applied to an image heating apparatus 2001 which uses a fixing heat roller 2011 incorporating a heating member 3011 as a rotating member. The image heating apparatus 2001 includes the heating member 3011 such as a lamp, the fixing heat roller 2011 formed of a hollow metal cylindrical member, an endless film 2021, and a nip forming member 3001 which forms a fixing nip portion N with the fixing heat roller 2011 via the endless film 2021. The image heating apparatus 2001 performs processing to fix a toner image on a recording material P to the recording material P by applying heat from the heating member 3011 via the fixing heat roller 2011 while nipping and conveying the recording material P in the fixing nip portion N. In the above-described apparatus, variation in temperature detection due to variation in a lubricant amount can be prevented by adopting the present disclosure in a positional relationship between the thermistor 212 as a temperature detection member and the lubricant the supply member 500.

Figure 8:
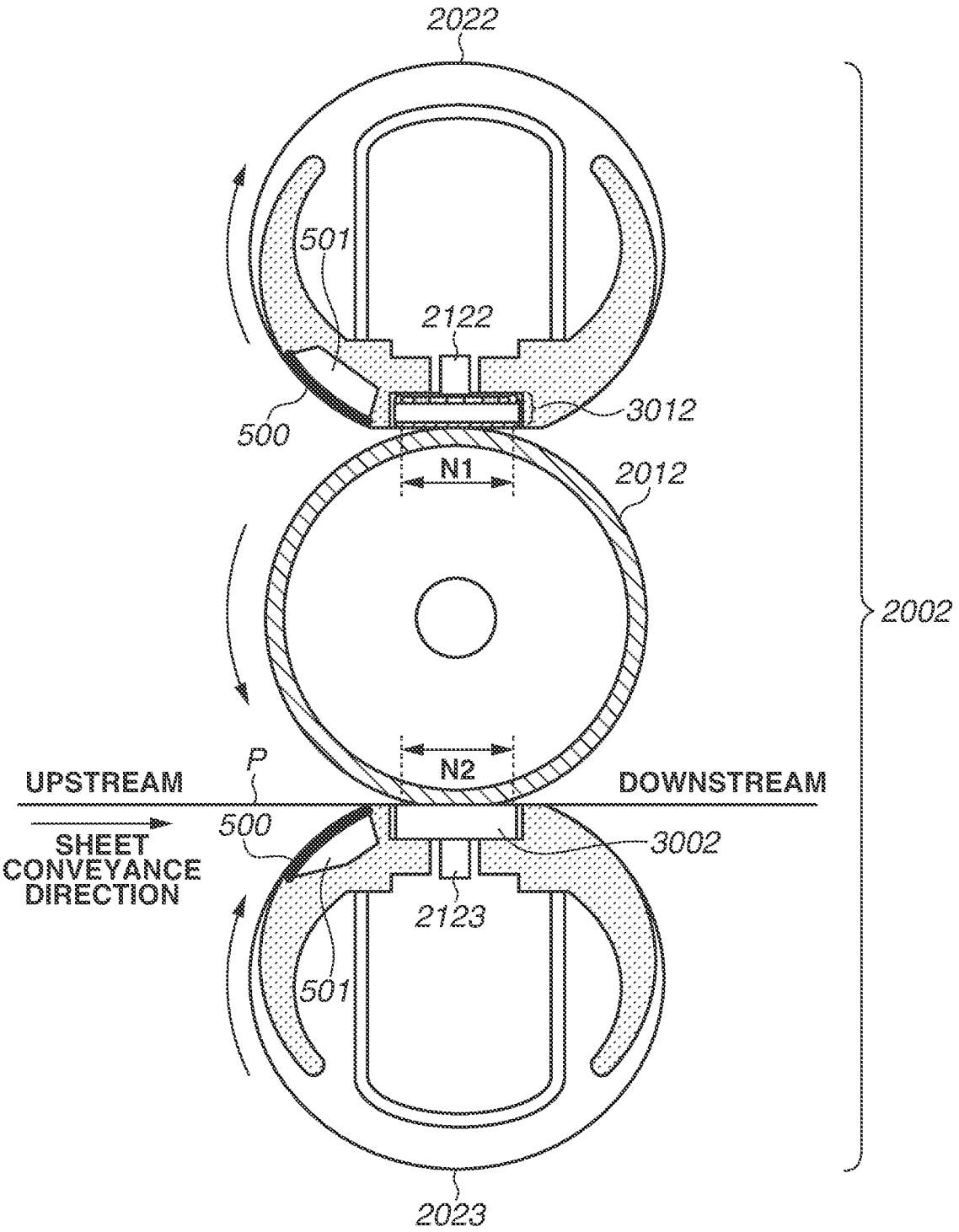
FIG. 8 illustrates a cross-sectional view of an image heating apparatus according to a modification of the first example embodiment.

Further, as illustrated in FIG. 8, the present disclosure may be applied to an image heating apparatus 2002 in which a heating nip portion N1 and a fixing nip portion N2 are formed on different positions. The image heating apparatus 2002 includes a heating member 3012, a fixing roller 2012 as a rotating member, a first endless film 2022, a nip forming member 3002, and a second endless film 2023. The heating member 3012 also has a function as a nip forming member which forms the heating nip portion N1 with the fixing roller 2012 via the first endless film 2022. The nip forming member 3002 forms the fixing nip portion N2 with the fixing roller 2012 via the second endless film 2023. The image heating apparatus 2002 heats a surface of the fixing roller 2012 by the first endless film 2022 which is heated by the heating member 3012 at the heating nip portion N1 and performs fixing processing to fix a loner image to a recording material P by applying heat from the fixing roller 2012 while nipping and conveying the recording material P in the fixing nip portion N2. Variation in temperature detection due to variation in a lubricant amount can be prevented by adopting the present disclosure in a positional relationship between thermistors 2122 and 2123 as the temperature detection members and the lubricant supply members 500.

While the present disclosure has been described with reference to example embodiments, it is to be understood that the disclosure is not limited to the disclosed example embodiments. The scope of the following claims is to be accorded the broadest interpretation so as to encompass all such modifications and equivalent structures and functions.

This application claims the benefit of Japanese Patent Application No. 2018-245434, filed Dec. 27, 2018, which is hereby incorporated by reference herein in its entirety.

What is claimed is:

1. An image heating apparatus which heats a recording material bearing an image, the image heating apparatus comprising:

a rotating member;

a nip forming member configured to form a nip portion with the rotating member;

a support member configured to support the nip forming member;

an endless film of which an inner peripheral surface slides on the nip forming member at the nip portion in a case where the endless film rotates around the support member;

a heating member configured to supply heat to the rotating member or the film;

a temperature detection element configured to detect a temperature;

a first supply member configured to supply a lubricant to the film, the first supply member being in contact with the inner peripheral surface of the film; and a second supply member which is different from the first supply member and is configured to supply the lubricant to the film, the second supply member being in contact with the film, wherein the temperature detection element is arranged between the first supply member and the second supply member in a longitudinal direction of the support member, and wherein the first supply member and the second supply member are arranged at positions different from a position of the nip forming member in a rotational direction of the film.

2. The image heating apparatus according to claim 1, wherein the support member includes a first storage unit configured to store the lubricant, and the first supply member is arranged to cover an opening portion of the first storage unit, and wherein the support member includes a second storage unit configured to store the lubricant, and the second supply member is arranged to cover an opening portion of the second storage unit.

3. The image heating apparatus according to claim 1, wherein the nip forming member is the heating member, and the nip portion is formed between the heating member and the rotating member via the film.

4. The image heating apparatus according to claim 1, wherein a plurality of supply members including the first supply member and the second supply member is arranged symmetrically with respect to a center of the nip portion in the longitudinal direction of the support member.

5. The image heating apparatus according to claim 1, wherein the temperature detection element detects a temperature of the nip forming member.

6. The image heating apparatus according to claim 1, wherein the temperature detection element detects a temperature of the film.

7. The image heating apparatus according to claim 1, wherein each of the first supply member and the second supply member is made of at least one of a porous fluorine resin, a porous polyimide resin, and a fiber layer.

8. The image heating apparatus according to claim 1, wherein a plurality of supply members includes the first supply member and the second supply member, and wherein a ratio of a length of a portion where no supply member is arranged is less than 15% with respect to a length of the nip portion in the longitudinal direction of the support member.

9. The image heating apparatus according to claim 1, further comprising a control unit configured to control a power supplied to the heating member in accordance with an output signal of the temperature detection element.

10. The image heating apparatus according to claim 1, wherein the first supply member and the second supply member are arranged at positions different from each other in the rotational direction of the film.

11. An image heating apparatus which heats a recording material bearing an image at a nip portion, the image heating apparatus comprising:

an endless film;

a nip forming member provided in an inner space of the film;

a rotating member contacting an outer surface of the film, the rotating member forming the nip portion in cooperation with the nip forming member via the film;

a support member provided in the inner space of the film, the support member supporting the nip forming member along a longitudinal direction of the nip forming member;

a temperature detection element configured to detect a temperature;

a first supply member configured to supply a lubricant to the film, the first supply member being in contact with an inner peripheral surface of the film; and a second supply member which is different from the first supply member and is configured to supply the lubricant to the film, the second supply member being in contact with the inner peripheral surface of the film, wherein the temperature detection element is arranged between the first supply member and the second supply member in the longitudinal direction of the nip forming member, and wherein the first supply member and the second supply member are arranged at positions different from a position of the nip forming member in a rotational direction of the film.

12. The image heating apparatus according to claim 11, wherein the support member includes a first storage unit configured to store the lubricant, and the first supply member is arranged to cover an opening portion of the first storage unit, and wherein the support member includes a second storage unit configured to store the lubricant, and the second supply member is arranged to cover an opening portion of the second storage unit.

13. The image heating apparatus according to claim 11, wherein the nip forming member is a heating member that supplies heat to the film, and the nip portion is formed between the heating member and the rotating member via the film.

14. The image heating apparatus according to claim 11, wherein a plurality of supply members including the first supply member and the second supply member is arranged symmetrically with respect to a center of the nip portion in the longitudinal direction of the nip forming member.

15. The image heating apparatus according to claim 11, wherein the temperature detection element detects a temperature of the nip forming member.

16. The image heating apparatus according to claim 11, wherein the temperature detection element detects a temperature of the film.

17. The image heating apparatus according to claim 11, wherein each of the first supply member and the second supply member is made of at least one of a porous fluorine resin, a porous polyimide resin, and a fiber layer.

18. The image heating apparatus according to claim 11, wherein a plurality of supply members includes the first supply member and the second supply member, and wherein a ratio of a length of a portion where no supply member is arranged is less than 15% with respect to a length of the nip portion in the longitudinal direction of the support member.

19. The image heating apparatus according to claim 11, further comprising a control unit configured to control a power supplied to the heating member in accordance with an output signal of the temperature detection element.

20. The image heating apparatus according to claim 11, wherein the first supply member and the second supply member are arranged at positions different from each other in the rotational direction of the film.

* * * * *